US009057559B2

(12) United States Patent
Larsson et al.

(10) Patent No.: US 9,057,559 B2
(45) Date of Patent: Jun. 16, 2015

(54) CELLULOSE PULP DRYER HAVING BLOW BOXES, AND A METHOD OF DRYING A WEB OF CELLULOSE PULP

(75) Inventors: Ola Larsson, Vaxjo (SE); Roland Kampris, Farsta (SE); Tinh Sjokvist, Hovmantorp (SE)

(73) Assignee: ANDRITZ TECHNOLOGY AND ASSET MANAGEMENT GMBH (AT)

( * ) Notice: Subject to any disclaimer, the term of this patent is extended or adjusted under 35 U.S.C. 154(b) by 211 days.

(21) Appl. No.: 13/885,938

(22) PCT Filed: Nov. 15, 2011

(86) PCT No.: PCT/SE2011/051370
§ 371 (c)(1),
(2), (4) Date: May 16, 2013

(87) PCT Pub. No.: WO2012/067573
PCT Pub. Date: May 24, 2012

(65) Prior Publication Data

US 2013/0239431 A1 Sep. 19, 2013

(30) Foreign Application Priority Data

Nov. 16, 2010 (SE) ..... 1051202

(51) Int. Cl.
*F26B 13/00* (2006.01)
*D21F 5/18* (2006.01)
*F26B 13/20* (2006.01)

(52) U.S. Cl.
CPC ..... *F26B 13/00* (2013.01); *D21F 5/187* (2013.01); *F26B 13/104* (2013.01)

(58) Field of Classification Search
CPC ..... F26B 3/00; F26B 5/00; F26B 13/00; F26B 19/00; B41F 33/00; B41F 33/18; D21F 5/00; D21F 5/13
USPC ..... 34/467, 497, 124, 618
See application file for complete search history.

(56) References Cited

U.S. PATENT DOCUMENTS

| | | | |
|---|---|---|---|
| 1,196,156 | A | 8/1916 | Savidge |
| 3,549,070 | A | 12/1970 | Frost et al. |
| 3,771,239 | A | 11/1973 | Minoda et al. |
| 3,849,904 | A | 11/1974 | Villalobos |
| 3,910,701 | A | 10/1975 | Henderson et al. |
| 3,982,328 | A | 9/1976 | Gustafsson et al. |

(Continued)

FOREIGN PATENT DOCUMENTS

| | | |
|---|---|---|
| EP | 1219589 | 7/2002 |
| GB | 1452383 | 10/1976 |

(Continued)

OTHER PUBLICATIONS

International Search Report for PCT/SE2011/051370, Completed by the Swedish Patent Office on Feb. 20, 2012, 4 Pages.

*Primary Examiner* — Steve M Gravini
(74) *Attorney, Agent, or Firm* — Brooks Kushman P.C.

(57) ABSTRACT

A cellulose pulp drying box for drying a web of cellulose pulp having blow boxes that are operative for blowing gas towards the web of cellulose pulp for drying the pulp. At least 10% of the total number of blow boxes of the drying box are provided, in their respective face, with openings having a characteristic measure of 1.8 to 3. mm and constituting at least 20% of the total degree of perforation of the face of the respective blow box.

15 Claims, 7 Drawing Sheets

(56) References Cited

U.S. PATENT DOCUMENTS

| | | | | |
|---|---|---|---|---|
| 4,021,031 | A | 5/1977 | Meihofer et al. | |
| 4,049,213 | A | 9/1977 | Hank et al. | |
| 4,146,797 | A | 3/1979 | Nakagawa | |
| 4,212,113 | A | 7/1980 | Andersson | |
| 4,290,210 | A | 9/1981 | Johansson | |
| 4,312,139 | A | 1/1982 | Preisler et al. | |
| 4,606,137 | A | 8/1986 | Whipple | |
| 4,837,947 | A | 6/1989 | Krieger | |
| 4,938,406 | A | 7/1990 | Nakashima et al. | |
| 5,467,194 | A | 11/1995 | Pellinen et al. | |
| 5,471,766 | A | 12/1995 | Heikkila et al. | |
| 5,667,124 | A | 9/1997 | Bannenberg | |
| 5,749,164 | A | 5/1998 | Bowden | |
| 5,947,024 | A | 9/1999 | Birkenfeld | |
| 6,092,304 | A * | 7/2000 | Karlsson et al. | 34/640 |
| 6,155,518 | A | 12/2000 | Bannenberg | |
| 6,230,422 | B1 | 5/2001 | Sairanen | |
| 6,231,001 | B1 | 5/2001 | Kramer et al. | |
| 6,526,369 | B1 | 2/2003 | Meinecke et al. | |
| 6,531,623 | B2 | 3/2003 | Chrisochoou et al. | |
| 6,905,573 | B2 | 6/2005 | Maenpaa et al. | |
| 7,325,331 | B2 | 2/2008 | Luukkanen | |
| 7,363,730 | B2 | 4/2008 | Huhtala et al. | |
| 7,972,480 | B2 | 7/2011 | Huhtala et al. | |
| 2002/0023369 | A1 | 2/2002 | Augscheller et al. | |
| 2005/0126031 | A1 * | 6/2005 | Herman et al. | 34/114 |
| 2007/0272883 | A1 | 11/2007 | Hennes et al. | |
| 2009/0165614 | A1 | 7/2009 | Petersson et al. | |
| 2013/0239431 | A1 * | 9/2013 | Larsson et al. | 34/467 |

FOREIGN PATENT DOCUMENTS

| | | |
|---|---|---|
| WO | 9408188 | 4/1994 |
| WO | 9716594 | 5/1997 |
| WO | 9737181 | 10/1997 |
| WO | 9856985 | 12/1998 |
| WO | 9919563 | 4/1999 |
| WO | 9936615 | 7/1999 |
| WO | 0102643 | 1/2001 |
| WO | 0220901 | 3/2002 |
| WO | 0250370 | 6/2002 |
| WO | 02101143 | 12/2002 |
| WO | 03004764 | 1/2003 |
| WO | 2007065968 | 6/2007 |
| WO | 2007108738 | 9/2007 |
| WO | 2009154549 | 12/2009 |
| WO | 2012067570 | 5/2012 |
| WO | 2012067573 | 5/2012 |

* cited by examiner

CELLULOSE PULP DRYER HAVING BLOW BOXES, AND A METHOD OF DRYING A WEB OF CELLULOSE PULP

CROSS-REFERENCE TO RELATED APPLICATION

This application is the U.S. national phase of PCT Application No.: PCT/SE2011/051370 filed on Nov. 15, 2011, which claims priority to Swedish Patent Application No.: 1051202-8 filed on Nov. 16, 2010, the disclosures of which are incorporated in their entirety by reference herein.

FIELD OF THE INVENTION

The present invention relates to a cellulose pulp drying box for drying a web of cellulose pulp, wherein the cellulose pulp drying box comprises blow boxes that are operative for blowing gas towards the web of cellulose pulp for drying the pulp.

The present invention further relates to a method of drying a web of cellulose pulp.

BACKGROUND OF THE INVENTION

Cellulose pulp is often dried in a convective type of dryer operating in accordance with the airborne web principle. An example of such a dryer is described in WO 2009/154549. Hot air is blown onto a web of cellulose pulp by means of upper blow boxes and lower blow boxes. The air blown by the blow boxes transfer heat to the web to dry it, and also keeps the web floating above the lower blow boxes. Hot air is supplied to the blow boxes by means of a circulation air system comprising fans and steam radiators heating the drying air. A complete cellulose pulp dryer is illustrated in WO 99/36615.

With increasing demands for increased pulp production in pulp mills, there is a desire to increase the drying capacity of a pulp dryer without increasing its size, or increasing its size only slightly.

SUMMARY OF THE INVENTION

An object of the present invention is to provide an arrangement for drying a cellulose pulp web, the arrangement being more space efficient than the prior art arrangements.

This object is achieved by means of a cellulose pulp drying box for drying a web of cellulose pulp, wherein the cellulose pulp drying box comprises blow boxes that are operative for blowing gas towards the web of cellulose pulp for drying the pulp, wherein at least 10% of the total number of blow boxes of the drying box are provided, in their respective face, with openings having a characteristic measure of 1.8 to 3.1 mm and constituting at least 20% of the total degree of perforation of the face of the respective blow box.

An advantage of this invention is that the heat transfer between the blow boxes and the web of cellulose pulp is improved. Hence, for a certain size of cellulose pulp dryer, a larger amount of cellulose pulp can be dried, compared to the prior art.

According to one embodiment the openings having a characteristic measure of 1.8 to 3.1 mm are non-inclined type openings. An advantage of this embodiment is that non-inclined openings tend to be more efficient in heat transfer than inclination type openings.

According to one embodiment at least one blow box of the drying box comprises non-inclined type openings having a characteristic measure of 1.8 to 3.1 mm and constituting at least 75% of the total degree of perforation of the blow box. An advantage of this embodiment is that the heat transfer becomes very efficient when non-inclined openings constitute as much as at least 75% of the total degree of perforation of the blow box.

According to one embodiment at least 10% of the total number of blow boxes of the drying box comprises non-inclined type openings having a characteristic measure of 1.8 to 3.1 mm and constituting at least 75% of the total degree of perforation of the respective blow box. This embodiment further improves the heat transfer, since a substantial amount of the total amount of drying gas will be blown from the most efficient type of openings, namely non-inclined openings having a characteristic measure of 1.8 to 3.1 mm. According to a further embodiment, non-inclined type openings having a characteristic measure of 1.8 to 3.1 mm constitute at least 85% of the total degree of perforation of the respective blow box.

According to one embodiment the drying box comprises lower blow boxes arranged to bear the web and dry the pulp in accordance with the airborne web principle, wherein at least 20% of the total number of lower blow boxes of the drying box are provided, in their respective upper face, with openings having a characteristic measure of 1.8 to 3.1 mm and constituting at least 20% of the total degree of perforation of the upper face of the respective lower blow box. An advantage of this embodiment is that the drying becomes very efficient, with good support of the web.

According to one embodiment at least one lower blow box of the drying box comprises non-inclined type openings and inclination type openings, wherein the non-inclined type openings have a characteristic measure of 1.8 to 3.1 mm and constitute at least 20% of the total degree of perforation of the lower blow box, and wherein the inclination type openings constitute at least 30% of the total degree of perforation of the lower blow box. An advantage of this embodiment is that fixation of the web, by means of gas blown from inclination type openings, and high heat transfer, by means of the non-inclined type openings having a characteristic measure of 1.8 to 3.1 mm, is combined in one and the same blow box.

According to one embodiment at least 10% of the total number of lower blow boxes of the drying box comprises non-inclined type openings and inclination type openings, wherein the non-inclined type openings have a characteristic measure of 1.8 to 3.1 mm and constitute at least 20% of the total degree of perforation of the respective lower blow box, and wherein the inclination type openings constitute at least 30% of the total degree of perforation of the respective lower blow box. An advantage of this embodiment is that good fixation of the web and high heat transfer may be combined, for example in a first drying zone of the drying box where the web is more sensitive to any stretching. According to a further embodiment, non-inclined type openings having a characteristic measure of 1.8 to 3.1 mm constitute at least 30% of the total degree of perforation of the respective lower blow box, and inclination type openings constitute at least 35% of the total degree of perforation of the respective lower blow box.

According to one embodiment at least 10% of the total number of lower blow boxes of the drying box comprises non-inclined type openings having a characteristic measure of 1.8 to 3.1 mm and constituting at least 75% of the total degree of perforation of the respective lower blow box, and at least 10% of the total number of lower blow boxes of the drying box comprises non-inclined type openings and inclination type openings, wherein the non-inclined type openings have a characteristic measure of 1.8 to 3.1 mm and constitute at least 20% of the total degree of perforation of the respective lower blow box, and wherein the inclination type openings constitute at least 30% of the total degree of perforation of the respective lower blow box. An advantage of this embodiment is that a combination of fixation of the web and high heat transfer may be utilized in that portion of the drying box where the web is comparably weak, and an even higher heat transfer, but low fixation of the web, may be utilized in that portion of the drying box where the web is comparably strong.

According to one embodiment the drying box further comprises at least one drying winding comprising blow boxes arranged to blow gas from both sides of a vertically travelling web of cellulose pulp in accordance with the vertical cellulose pulp drying principle.

According to one embodiment said characteristic measure of the openings is 2.0 to 2.8 mm. According to a further embodiment, said characteristic measure of the openings is 2.2 to 2.7 mm.

A further object of the present invention is to provide a method of drying a cellulose pulp web in a more efficient manner than the methods of the prior art.

This object is achieved by means of a method of drying a web of cellulose pulp by means of blow boxes that are operative for blowing gas towards the web of cellulose pulp for drying the pulp, the method comprising blowing gas towards the web from blow boxes, wherein, in at least 10% of the total number of blow boxes, at least 20% of the total amount of gas blown towards the web is blown from openings having a characteristic measure of 1.8 to 3.1 mm.

An advantage of this method is that the gas blown form the openings having a characteristic measure of 1.8 to 3.1 mm is very efficient in drying the web, thereby increasing the efficiency of the drying process.

According to one embodiment, in at least 10% of the total number of blow boxes blowing gas towards the web, at least 75% of the total amount of gas blown towards the web is blown from non-inclined type openings having a characteristic measure of 1.8 to 3.1 mm. An advantage of this embodiment is that with a substantial amount of gas blown from non-inclined type openings having a characteristic measure of 1.8 to 3.1 mm the drying will become very efficient.

According to one embodiment, in at least 10% of the total number of blow boxes blowing gas towards the web, at least 20% of the total amount of gas blown towards the web is blown from non-inclined type openings having a characteristic measure of 1.8 to 3.1 mm, and wherein at least 30% of the total amount of gas blown towards the web is blown from inclination type openings. An advantage of this embodiment is that high heat transfer and fixation of the web will be combined to yield efficient drying and low stretching forces in the web.

According to one embodiment the method comprises blowing gas towards the web from lower blow boxes arranged to bear the web for drying the pulp in accordance with the airborne web principle, wherein, in at least 20% of the total number of lower blow boxes, at least 20% of the total amount of gas blown towards the web is blown from openings having a characteristic measure of 1.8 to 3.1 mm.

According to a further aspect there is provided a cellulose pulp drying box for drying a web of cellulose pulp, wherein the cellulose pulp drying box comprises blow boxes that are operative for blowing gas towards the web of cellulose pulp for drying the pulp in accordance with the airborne web principle, wherein the drying box comprises lower blow boxes arranged to bear the web, wherein at least 20% of the total number of lower blow boxes of the drying box are provided, in their respective upper face, with openings having a characteristic measure of 1.8 to 3.1 mm and constituting at least 20% of the total degree of perforation of the upper face of the respective lower blow box.

According to a still further aspect there is provided a method of drying a web of cellulose pulp by means of blow boxes that are operative for blowing gas towards the web of cellulose pulp for drying the pulp in accordance with the airborne web principle, wherein the method comprises blowing gas towards the web from lower blow boxes arranged to bear the web, wherein, in at least 20% of the total number of lower blow boxes, at least 20% of the total amount of gas blown towards the web is blown from openings having a characteristic measure of 1.8 to 3.1 mm.

Further objects and features of the present invention will be apparent from the description and the claims.

BRIEF DESCRIPTION OF THE DRAWINGS

The invention will now be described in more detail with reference to the appended drawings in which.

DESCRIPTION OF PREFERRED EMBODIMENTS

Figure 1:
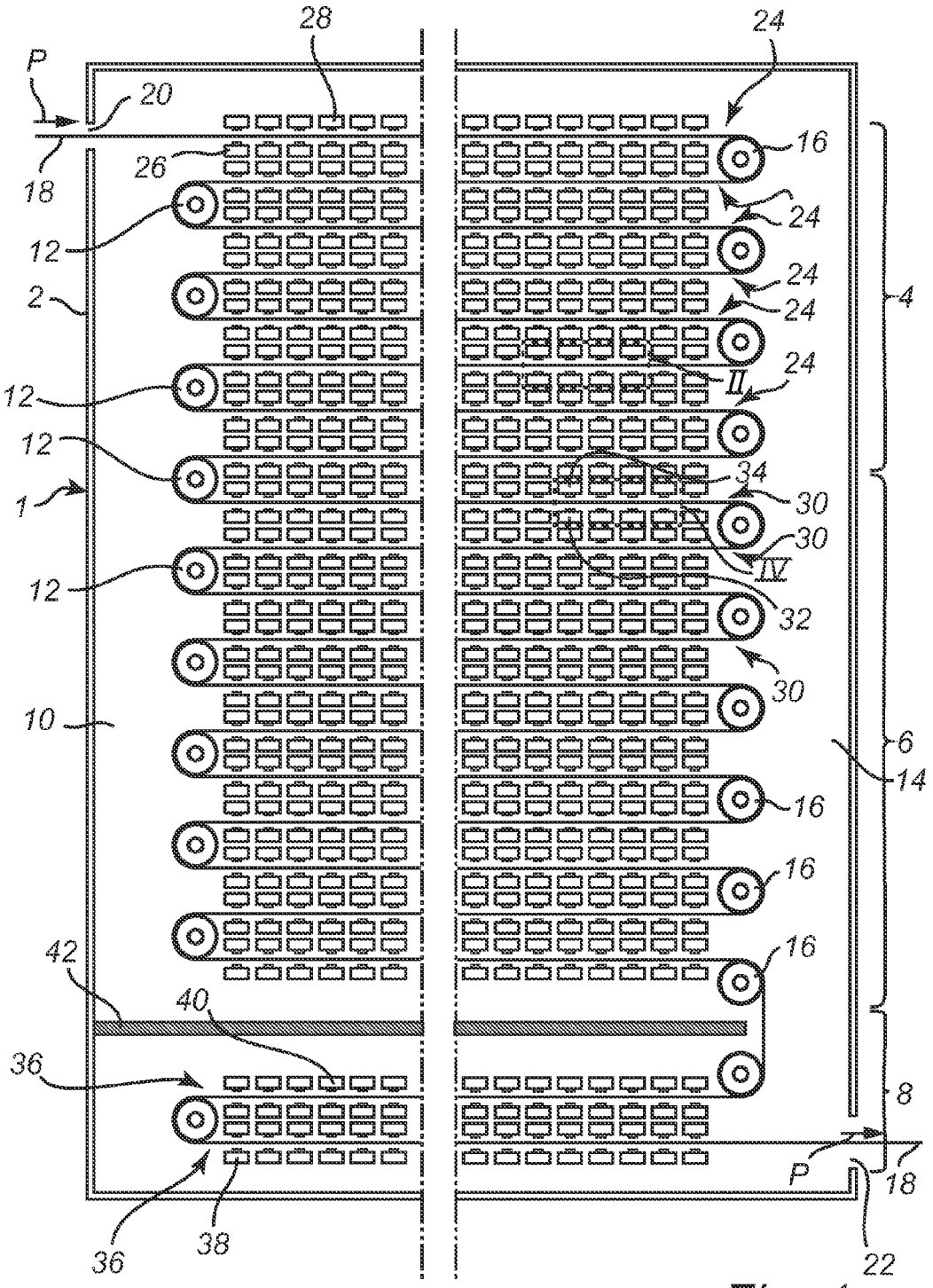
FIG. 1 is a schematic side view, and illustrates a drying box for drying a web of cellulose pulp.

FIG. 1 illustrates a cellulose pulp drying box 1 for drying cellulose pulp in accordance with a first embodiment of the present invention. The drying box 1 comprises a housing 2. Inside the housing 2 a first drying zone 4, a second drying zone 6, and an optional cooling zone 8 may, in one exemplary embodiment, be arranged, with the first drying zone 4 arranged in the upper region of the housing 2, the cooling zone 8 arranged in the lower region of the housing 2, and the second drying zone 6 being arranged between the first drying zone 4 and the cooling zone 8.

At a first end 10 of the housing 2 a first column of turnings rolls 12 is arranged, and at a second end 14 of the housing 2 a second column of turning rolls 16 is arranged. A wet pulp web 18 enters the drying box 1 via an inlet 20 arranged in the housing 2. In the embodiment of FIG. 1, the inlet 20 is arranged in the upper portion of the housing 2, but the inlet may, in an alternative embodiment, be arranged in the lower portion of the housing. The web 18 is forwarded horizontally, towards the right as illustrated in FIG. 1, in the drying box 1 until the web 18 reaches a turning roll. In the drying box 1 illustrated in FIG. 1, the web 18 will first reach a turning roll 16 of the second column of turning rolls. The web 18 is turned around the turning roll 16, and then travels horizontally towards the left, as illustrated in FIG. 1, in the drying box 1 until the web 18 reaches a turning roll 12 of the first column of turning rolls, at which the web 18 is turned again. In this manner the web 18 travels, in a zigzag manner, from the top to the bottom of the drying box 1, as illustrated by arrows P. The web 18 leaves the drying box 1, after having been dried in the first and second drying zones 4, 6 and having been cooled in the cooling zone 8, via an outlet 22 arranged in the housing 2. In the embodiment of FIG. 1, the outlet 22 is arranged in the lower portion of the housing 2, but the outlet may, in an alternative embodiment, be arranged in the upper portion of the housing.

Typically, a gas in the form of air of a temperature of 80 to 250° C. is utilized for the drying process. The web 18 of cellulose pulp entering the drying box 1, from an upstream web forming station, not shown in FIG. 1, typically has a dry solids content of 40-60% by weight, and the web 18 of cellulose pulp leaving the drying box 1 has a dry solids content of typically 85-95% by weight. The web 18 of cellulose pulp leaving the drying box 1 typically has a basis weight of 800 to 1500 g/m$^2$, when measured at a moisture content of 0.11 kg water per kg dry substance, and a thickness of 0.8 to 3 mm.

The first drying zone 4 comprises at least one first drying deck 24, and typically 3-15 first drying decks 24. In the embodiment of FIG. 1, the first drying zone 4 comprises 8 first drying decks 24. Each such first drying deck 24 comprises a number of blow boxes, as will described in more detail hereinafter, and is operative for drying the web 18 while the web 18 travels horizontally from one turning roll 12, 16 to the next turning roll 16, 12. Each first drying deck 24 comprises a number of first lower blow boxes 26 and a number of first upper blow boxes 28 that are arranged for blowing a hot drying gas towards the cellulose pulp web 18. Typically, each first drying deck 24 comprises 20-300 first lower blow boxes 26 and the same number of first upper blow boxes 28, although in FIG. 1 in the interest of maintaining clarity of illustration only a few blow boxes are illustrated. The first lower blow boxes 26 are operative for keeping the web 18 in a "floating" and fixed condition, such that the web 18 becomes airborne at a distance from the first lower blow boxes 26 during the drying process, as will be described in more detail hereinafter.

The second drying zone 6 comprises at least one second drying deck 30, and typically 5-40 second drying decks 30. In the embodiment of FIG. 1, the second drying zone 6 comprises 11 second drying decks 30. Each such second drying deck 30 comprises a number of blow boxes, as will described in more detail hereinafter, and is operative for drying the web 18 while the web 18 travels horizontally from one turning roll 12, 16 to the next turning roll 16, 12. Each second drying deck 30 comprises a number of second lower blow boxes 32 and a number of second upper blow boxes 34 that are arranged for blowing a hot drying gas towards the cellulose pulp web 18.

Typically, each second drying deck 30 comprises 20-300 second lower blow boxes 32 and the same number of second upper blow boxes 34, although in FIG. 1 in the interest of maintaining clarity of illustration only a few blow boxes are illustrated. The second lower blow boxes 32 are operative for keeping the web 18 in a "floating" condition, such that the web 18 becomes airborne at a distance from the second lower blow boxes 32 during the drying process, as will be described in more detail hereinafter.

The first drying decks 24 of the first drying zone 4 have a different mechanical design than the second drying decks 30 of the second drying zone 6, as will be described in more detail hereinafter. Often the first lower blow boxes 26 of the first drying decks 24 would have a different mechanical design than the second lower blow boxes 32 of the second drying decks 30, as will be illustrated by means of an example hereinafter.

Figure 2:
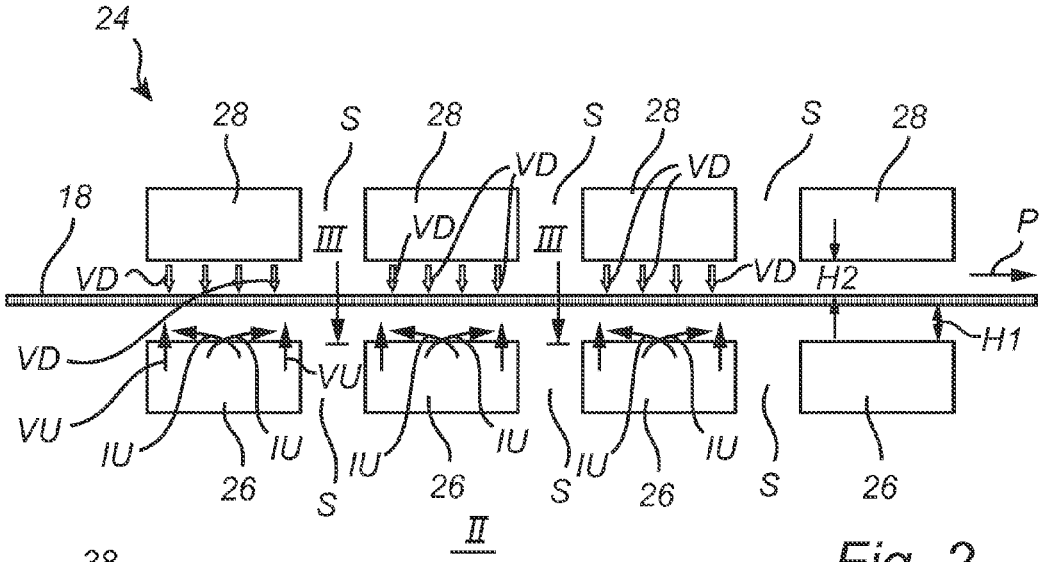
FIG. 2 is a schematic side view, and illustrates the area II of FIG. 1.

The cooling zone 8 comprises at least one cooling deck 36, in FIG. 2 two such cooling decks 36 are illustrated, each such deck 36 comprising a number of third lower blow boxes 38 and third upper blow boxes 40 that are arranged for blowing a cooling gas towards the cellulose pulp web 18. The lower blow boxes 38 are operative for keeping the web 18 in a "floating" condition, such that the web 18 becomes airborne during the cooling process. Typically, air of a temperature of 15 to 40° C. is utilized as a cooling gas for the cooling process. An isolated wall 42 separates the second drying zone 6 from the cooling zone 8.

FIG. 2 is an enlarged side view of the area II of FIG. 1 and illustrates a first drying deck 24 of the first drying zone 4 illustrated in FIG. 1. The first drying deck 24 comprises the first lower blow boxes 26 arranged below the web 18, and the first upper blow boxes 28 arranged above the web 18. The first lower blow boxes 26 blow hot drying air towards the web 18 both vertically upwards towards web 18, illustrated by arrows VU in FIG. 2, and in an inclined manner, at an angle of typically 5 to 60° to the horizontal plane, as illustrated by means of arrows IU in FIG. 2. The blowing of drying air at an inclination to the horizontal plane by the first lower blow boxes 26 yield both forces forcing the web 18 upwards away from the blow boxes 26, and forces forcing the web 18 downwards towards the blow boxes 26. The latter effect is sometimes referred to as the Coanda effect. This will result in the blow boxes 26 exerting a fixation force on the web 18, holding the web at a comparably well defined distance from the blow boxes 26. Typically, the average distance, or height H1, between the lower side of the web 18 and the upper surface of the first lower blow boxes 26 is 3-6 mm during operation of the drying box 1. If the web 18 would tend to move upwards, the fixation forces of the blow boxes 26 would drag the web 18 downwards, and if the web 18 would tend to move downwards, the air blown by the blow boxes 26 would force the web 18 upwards. Hence, the web 18 is transported horizontally along the first drying deck 24 in a relatively fixed manner, with little movement in the vertical direction, meaning that the web 18 is subjected to limited stretching forces. The first type of upper blow boxes 28 blow hot drying air towards the web 18 vertically downwards towards web 18, illustrated by arrows VD in FIG. 2. Typically, the average distance, or height H2, between the upper side of the web 18 and the lower surface of the first upper blow boxes 28 is 10 to 80 mm. The hot drying air blown by the blow boxes 26, 28 is evacuated via gaps S formed between horizontally adjacent blow boxes 26, 28.

Figure 3:
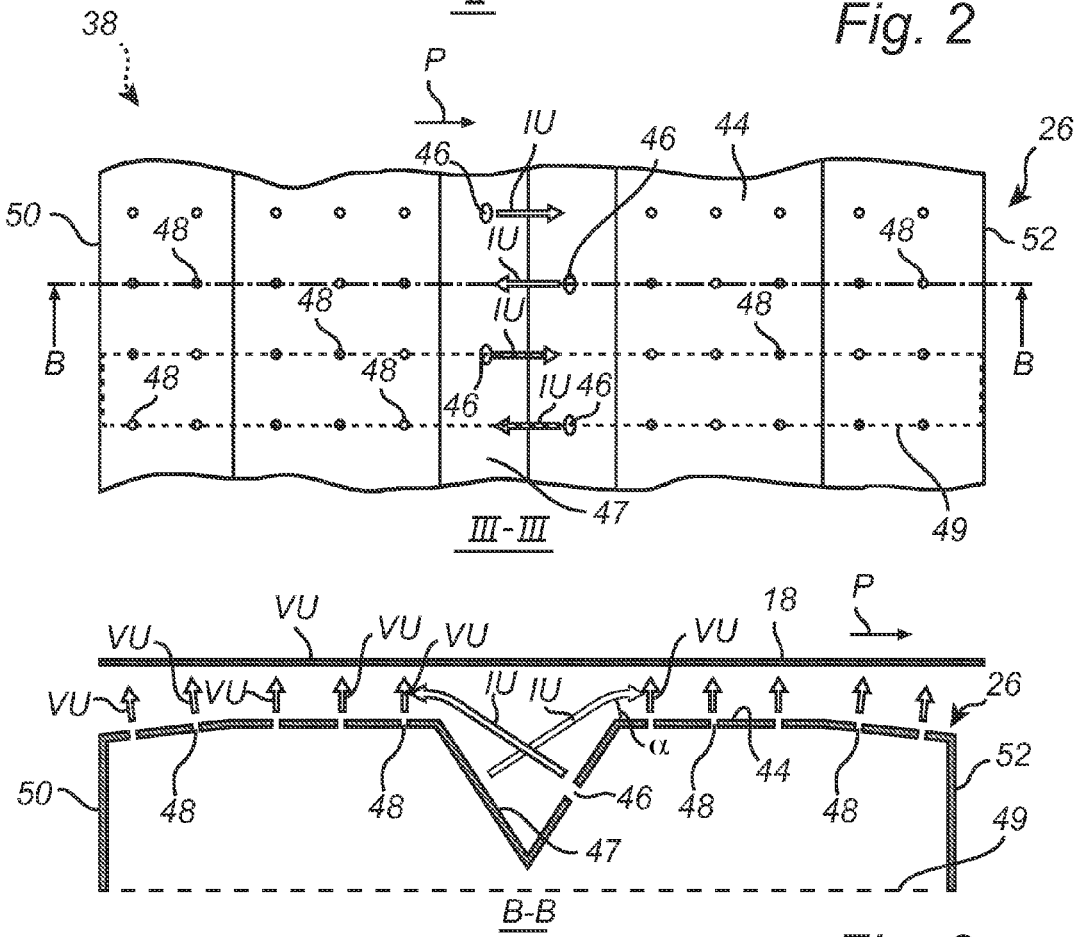
FIG. 3 depicts schematic top and cross-sectional views, and illustrates a first lower blow box as seen in the direction of the arrows III-III of FIG. 2.

FIG. 3 is a schematic top view, and illustrates the first lower blow box 26 as seen in the direction of the arrows III-III of FIG. 2. An arrow P illustrates the intended path along which the web, not shown in FIG. 3, is to pass over an upper face 44 of the first lower blow box 26. The upper face 44 comprises centrally arranged first type of openings 46, which are "inclination type" openings of a type sometimes referred to as "groove perforations". By "inclination type" openings is meant that at least 25% of the air blown from those openings 46 is blown at an angle $\alpha$ of less than 60° to the upper face 44 of the first lower blow box 26, as is best illustrated in the cross-section B-B of FIG. 3. In the first lower blow box 26 at least 30%, often at least 40%, of the total flow of air supplied thereto is blown from openings of the "inclination type", for example via groove perforations 46. As best illustrated in the cross-section B-B included at the bottom of FIG. 3, the groove perforations 46 may be round holes, that are arranged in a groove 47 which is arranged centrally in the upper face 44 of the first lower blow box 26. An example of a blow box with a groove and having groove perforations arranged in the groove is illustrated in U.S. Pat. No. 4,837,947. A portion of the flow of air blown via the groove perforations 46 may be blown at an angle which is larger than 60°. Of the total air flow supplied to the lower blow box 26, at least 25% may be blown at an angle $\alpha$ of less than 60° to the upper face 44 of the first lower blow box 26.

The groove perforations 46 provide the hot drying air blown therethrough with an inclination, such that the inclined flows IU illustrated in FIGS. 2 and 3 are generated. As can be seen from FIG. 3 of the present application, the perforations 46 are arranged in the groove 47 in an alternating manner, such that every second flow IU will be directed to the left, as illustrated in FIG. 3, and every second flow IU will be directed to the right.

Continuing with the description of FIG. 3 of the present application, the upper face 44 is provided with a second type of openings 48, that are arranged between the groove 47 and the respective sides 50, 52 of the blow box 26. The second type of openings 48 are of a "non-inclined type" that are distributed over the upper face 44. By "non-inclined type" is meant that at least 80% of the air blown from those openings 48 is blown at an angle to the upper surface 44 which is at least 70°. Typically, almost the entire flow of air would be blown almost vertically, i.e., at an angle of close to 90° to the upper surface 44, from the openings 48 of the non-inclined type. The openings 48 may be round holes, with a characteristic measure in the form of a diameter of 1.8 to 3.1 mm. According to one embodiment, the openings 48 have a diameter of 2.0 to 2.8 mm. According to a further embodiment, the openings 48 have a diameter of 2.2 to 2.7 mm. The second type of openings 48 blow the hot drying air upwards to form the flows VU, as best illustrated in the cross-section B-B of FIG. 3. As can be seen from the cross-section B-B of FIG. 3, the outer portions of the upper face 44 slope slightly downwards. This is done for the purpose of reducing the risk that the web 18 touches the blow box 26 adjacent to its sides 50, 52. Hence, those openings 48 that are located adjacent to the sides 50, 52 may blow most of the air supplied thereto at an angle of typically about 85° to the horizontal plane.

By varying the number and size of the first type of openings 46 and the number and size of the second type of openings 48 a suitable pressure-drop relation between first and second types of openings 46, 48 may be achieved, such that, for example, 65% of the total flow of air blown to the first lower blow box 26 is ejected via the first type of openings 46, and 35% of the total flow of air blown to the first lower blow box 26 is ejected via the second type of openings 48. A degree of perforation of a blow box 26 may be calculated by dividing the total open area of the openings 46, 48 of a representative portion of the upper face 44 by the horizontally projected area 49 of the representative portion of the upper face 44. By "representative portion" is meant a portion of the upper face 44 which is representative with respect to the blowing of air towards the web 18, i.e. disregarding for example the air inlet part of the blow box. The degree of perforation, may, for example, be 1.5%. The degree of perforation can be varied to suit the weight, dryness, etc. of the web 18 to be dried. Often the degree of perforation of the first lower blow box 26 would be 0.5-3.0%. The second type of openings 48 being non-inclined type of openings and having a diameter of 1.8 to 3.1 mm typically constitute at least 20% of the total degree of perforation of the first lower blow boxes 26, and typically 30-70% of the total degree of perforation of the first lower blow boxes 26. The first type of openings 46 being inclination type of openings may typically constitute at least 30% of the total degree of perforation of the first lower blow boxes 26, and typically 40-80% of the total degree of perforation of the first lower blow boxes 26.

For example, considering an area of the representative portion 49 of 5000 $mm^2$, and a degree of perforation of 2%, the total area of the openings 46, 48, would be 100 $mm^2$. If the first type of openings 46 would constitute 50% of the degree of perforation, that would correspond to 50 $mm^2$. This means that the second type of openings 48 would have a total open area corresponding to the remaining 50 $mm^2$, which, with openings 48 of a diameter of 2.5 mm, would correspond to about ten openings 48, each having an open area of about 4.9 $mm^2$.

Figure 4:
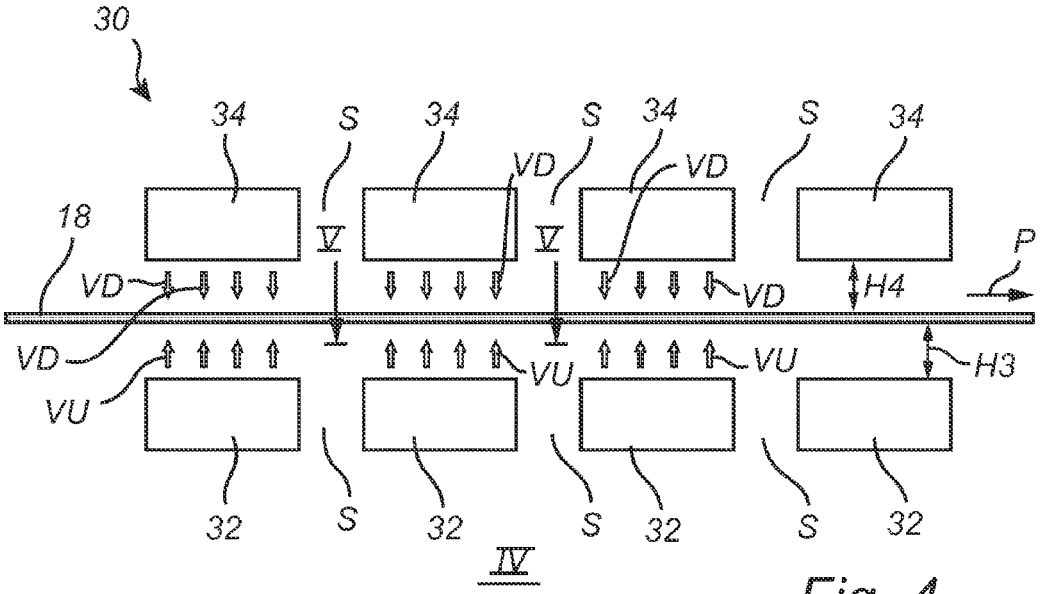
FIG. 4 is a schematic side view, and illustrates the area IV of FIG. 1.

FIG. 4 is an enlarged side view of the area IV of FIG. 1 and illustrates a second drying deck 30 of the second drying zone 6 illustrated in FIG. 1. The second drying deck 30 comprises the second lower blow boxes 32 arranged below the web 18, and the second upper blow boxes 34 arranged above the web 18. The second lower blow boxes 32 blow hot drying air towards the web 18 vertically upwards towards web 18, illustrated by arrows VU in FIG. 4. The second lower blow boxes 32 of the second drying deck 30 exert a lower fixation force on the web 18 compared to the first lower blow boxes 26 of the first drying deck 24, illustrated in FIGS. 2 and 3. The fixation force exerted on the web by the second lower blow boxes 32 is normally rather low, or even non-existing. Returning to FIG. 4, the hot drying air supplied from the second lower blow boxes 32 lifts the web to a height at which the weight of the web 18 is in balance with the lifting force of the hot drying air supplied by the second lower blow boxes 32. Typically, the average distance, or height H3, between the lower side of the web 18 and the upper surface of the second lower blow boxes 32 is 4 to 15 mm. Since there is a limited or even non-existing fixation force exerted by the second lower blow boxes 32 on the web 18, the vertical position of the web 18 will tend to fluctuate, during operation of the drying box 1, somewhat more when passing the second drying decks 30, compared to when passing the first drying decks 24. Hence, the web 18 is transported horizontally along the second drying deck 30 in a relatively free manner, with some movement in the vertical direction, meaning that the web 18 is subjected to some stretching forces. The second type of upper blow boxes 34 blow hot drying air towards the web 18 vertically downwards towards web 18, illustrated by arrows VD in FIG. 4. Typically, the average distance, or height H4, between the upper side of the web 18 and the lower surface of the second upper blow boxes 34 is 5 to 80 mm. The hot drying air blown by the blow boxes 32, 34 is evacuated via gaps S formed between horizontally adjacent blow boxes 32, 34.

Figure 5:
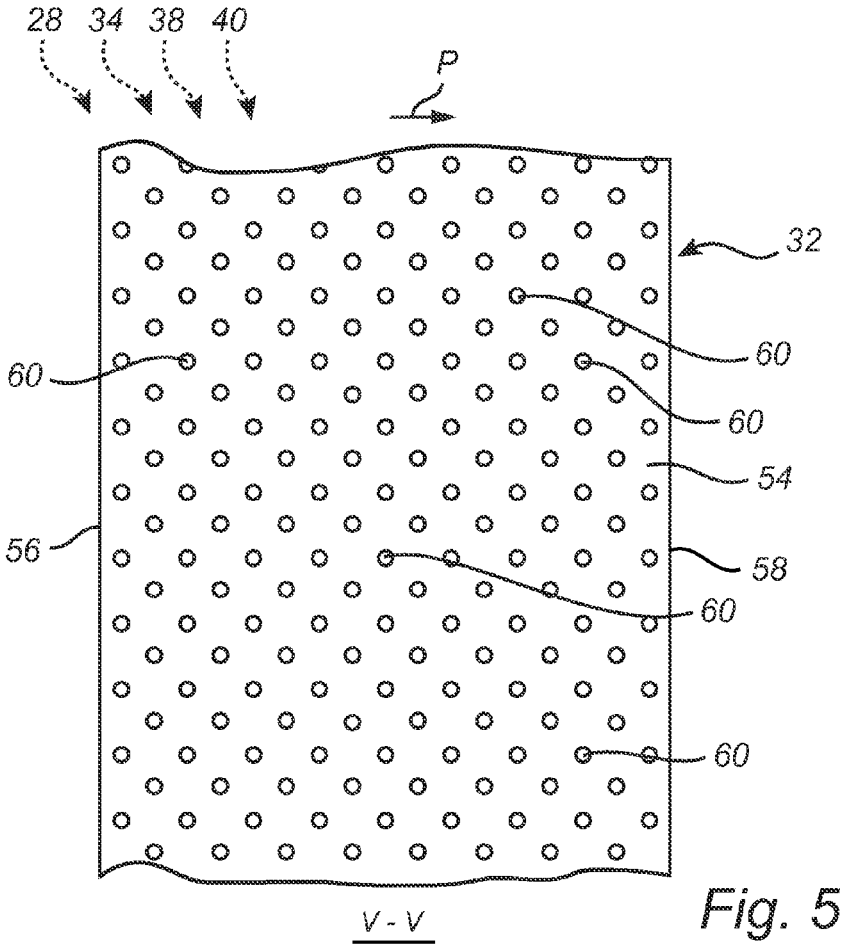
FIG. 5 is a schematic top view, and illustrates a second lower blow box as seen in the direction of the arrows V-V of FIG. 4.

FIG. 5 is a schematic top view, and illustrates the second lower blow box 32 as seen in the direction of the arrows V-V of FIG. 4. An arrow P illustrates the intended path along which the web, not shown in FIG. 5, is to pass over an upper face 54 of the second lower blow box 32. The upper face 54 extends between the sides 56, 58 of the blow box 32 and comprises openings 60 of the "non-inclined type" that are distributed over the upper face 54. By "non-inclined type" is, in accordance with the previous definition, meant that at least 80% of the air blown from those openings 60 is blown at an angle to the upper face 54 which is at least 70°. Typically, almost the entire flow of air would be blown almost vertically, i.e., at an angle of close to 90° to the upper face 54, from the openings 60 of the non-inclined type. In the second lower blow box 32 at least 75% of the total flow of air supplied thereto is blown from openings of the non-inclined type. In the embodiment illustrated in FIG. 5, 100% of the total flow of air supplied thereto is blown from the openings 60 of the non-inclined type. The openings 60 may be evenly distributed over the face 54, but may also be distributed in an uneven manner. As can be seen from FIG. 5, the concentration of openings 60 (openings per square centimeter of upper face 54) is somewhat higher adjacent to the sides 56, 58. The openings 60 of the blow box 32 may be round holes, with a characteristic measure in the form of a diameter of 1.8 to 3.1 mm. According to one embodiment, the openings 60 have a diameter of 2.0 to 2.8 mm. According to a further embodiment, the openings 60 have a diameter of 2.2 to 2.7 mm. The openings 60 blow the hot drying air vertically upwards to form the flows VU.

The degree of perforation, as defined hereinabove, may, for example, be 1.5% in the second lower blow box 32. The degree of perforation can be varied to suit the weight, dryness, etc. of the web 18 to be dried. Often the degree of perforation of the second lower blow box 32 would be 0.5-3.0%. The openings 60 having a diameter of 1.8 to 3.1 mm typically constitute at least 75% of the total degree of perforation of the second lower blow boxes 32, and typically 80-100% of the total degree of perforation of the second lower blow boxes 32. The openings 60 having a diameter of 1.8 to 3.1 mm constitute, for example, 100% of the total degree of perforation in the exemplary lower blow box 32 illustrated in FIG. 5.

The first upper blow boxes 28 of the first drying decks 24, illustrated in FIG. 2, and the second upper blow boxes 34 of the second drying decks 30, illustrated in FIG. 4, may have the same general design as the second lower box 32 illustrated in FIG. 5, as indicated by dashed arrows in FIG. 5.

Furthermore, the third lower blow boxes 38 and the third upper blow boxes 40 of the cooling zone 8 may also have a similar design as the second lower blow boxes 32 illustrated in FIG. 5, as illustrated by means of dashed arrows. In accordance with an alternative embodiment, the third lower blow boxes 38 may have a similar design as the first lower blow boxes 26 illustrated in FIG. 3, as illustrated by means of a dashed arrow.

The above mentioned average distances H1, H2, H3, H4, all refer to the shortest distance between the face 44, 54 of the respective blow box 26, 28, 32, 34 and the web 18.

Figure 6:
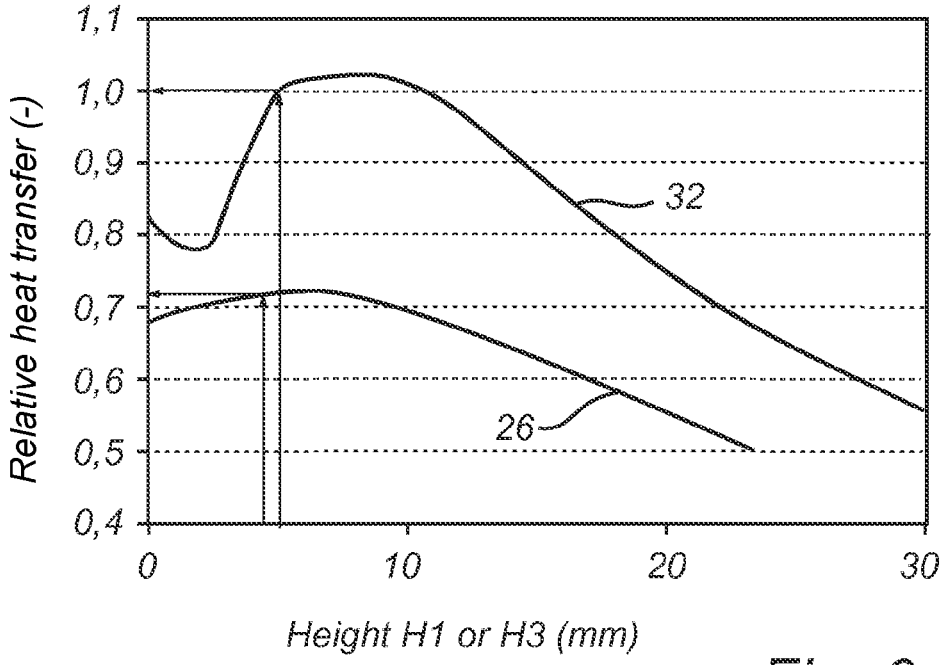
FIG. 6 is a diagram and illustrates the relative heat transfer of the first and second lower blow boxes.

FIG. 6 is a diagram and illustrates the relative heat transfer between the web 18 and the first lower blow boxes 26 of the first drying decks 24, and by the second lower blow boxes 32 of the second drying decks 30, respectively. On the horizontal axis, the X-axis, the average distance, or height H1, and H3, respectively, between the lower side of the web 18 and the upper face 44, 54 of the respective blow box 26, 32 is indicated. On the vertical axis, the Y-axis, the relative heat transfer from the respective blow box 26, 32 to the web 18 is indicated. The relative heat transfer is 1.0 at an average distance H3 of 5 mm of the second lower blow boxes 32, and all other relative heat transfer values are calculated in relation to that heat transfer.

As described hereinbefore, the equilibrium distance H1 between the web 18 and the first lower blow boxes 26 of the first drying zone 4 may typically be 3-6 mm. In one example, the distance H1 may be about 4.5 mm. Looking at the curve "26" for the first lower blow boxes 26 of FIG. 6, it is clear that a relative heat transfer of about 0.72 would correspond to a height H1 of 4.5 mm. Furthermore, it may be recalled from the previous description that the equilibrium distance H3 between the web 18 and the second lower blow boxes 32 of the second drying zone 6 is typically 4 to 15 mm. In one example, the distance H3 may be about 5 mm. Looking at the curve "32" for the second lower blow boxes 32 of FIG. 6, it is clear that a relative heat transfer of about 1.0 would correspond to a height H3 of about 5 mm.

From FIG. 6 and the above example, it is clear that the heat transfer of the second drying zone 6 is considerably higher than that of the first drying zone 4. Without being bound by any theory, it would seem as if the better heat transfer of the second drying zone 6 is attributed both to the fact that a longer distance between the web 18 and the respective blow box 26, 32 is beneficial to the heat transfer, at least up to about 10 mm distance, and to the fact that the second lower blow boxes 32, with the hot drying air being blown predominantly in a vertical direction VU upwards towards the web 18 appear to be, as such, more efficient than the first lower blow boxes 26, blowing some of the hot drying air in an inclined manner. The first drying zone 4, on the other hand, provides a more stable control of the forwarding of the web 18, resulting in less stretching forces being exerted on the web 18. The tensile strength of the web 18 tends to increase with decreasing moisture content. Hence, the web 18 is comparably weak adjacent to the inlet 20 of the drying box 1, illustrated in FIG. 1, and is comparably strong adjacent to the outlet 22 of the drying box 1. In the first drying zone 4 the web is, hence, dried under low stretching conditions, with a quite stable path of the web, until the web has been dried to, for example, a dry solids content of about 55-80%. Then, with the web 18 having obtained a higher tensile strength, the web 18 is dried in the second drying zone 6 at conditions of higher stretching, but also with a very high heat transfer, making the drying efficient.

Figure 7:
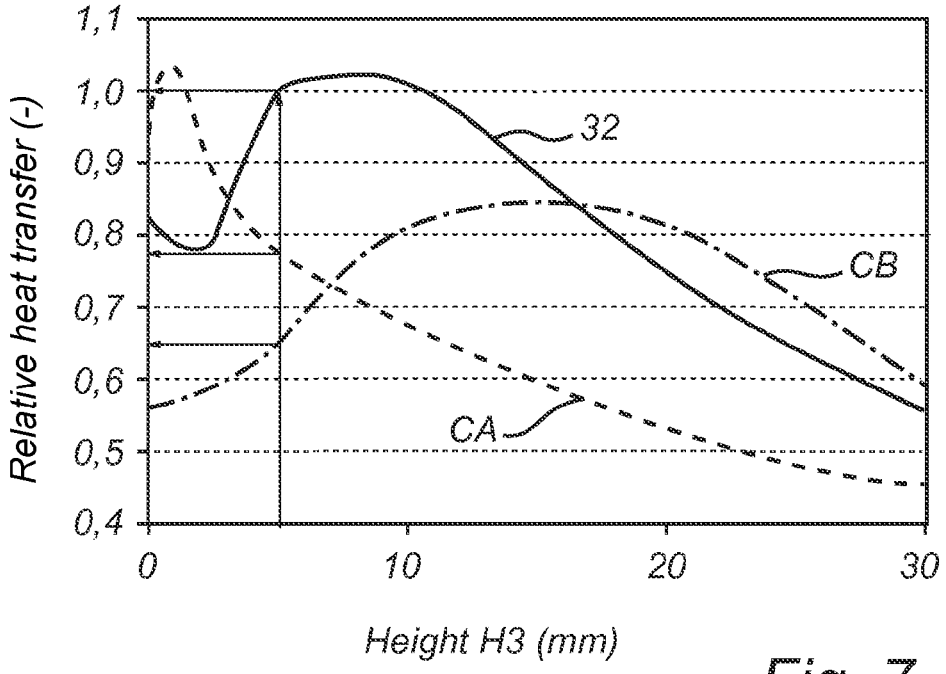
FIG. 7 is a diagram and illustrates the relative heat transfer of the second lower blow boxes as compared to first and second comparative blow boxes.

FIG. 7 is a diagram and illustrates the relative heat transfer between the web 18 and the second lower blow boxes 32 of the second drying decks 30, as compared with a first comparative lower blow box CA and a second comparative lower blow box CB. The second lower blow boxes 32 have a design which is of the type illustrated in FIG. 5 and is provided with openings 60 that are round and have a diameter of 2.5 mm. The degree of perforation, as defined hereinabove, is, in this example, 1.5%. The first comparative lower blow box CA has a design which is similar to that illustrated in FIG. 5, with the difference that the blow box CA is provided with round openings having a diameter of 1.0 mm. The second comparative lower blow box CB also has a design which is similar to that illustrated in FIG. 5, with the difference that the blow box CB is provided with round openings having a diameter of 5 mm. The degree of perforation of the first and second comparative blow boxes CA and CB is also 1.5%.

In FIG. 7, the horizontal axis, the X-axis, indicates the average distance, or height H3, between the lower side of the web 18 and the upper face 54 of the respective blow box 32, CA, and CB. On the vertical axis, the Y-axis, the relative heat transfer from the respective blow box 32, CA, CB to the web 18 is indicated. The relative heat transfer is 1.0 at an average distance H3 of 5 mm of the second lower blow boxes 32, and all other relative heat transfer values are calculated in relation to that heat transfer.

Continuing with the example given in conjunction with FIG. 6, it may be recalled from the example given in conjunction with FIG. 6 that the equilibrium distance H3 between the web 18 and the second lower blow boxes 32 of the second drying zone 6 was about 5 mm. Looking at the curve "32" for the second lower blow boxes 32 of FIG. 7, it is clear that a height H3 of about 5 mm would correspond to a relative heat transfer of about 1.0. Looking at the curve "CA" of FIG. 7 for the first comparative lower blow box CA, it is clear that a height H3 of about 5 mm would correspond to a relative heat transfer of about 0.78. Looking at the curve "CB" of FIG. 7 for the second comparative lower blow box CB, it is clear that a height H3 of about 5 mm would correspond to a relative heat transfer of about 0.65.

From FIG. 7 and the above example, it is clear that the heat transfer of the second lower blow boxes 32, having openings 60 with a diameter of 2.5 mm, is considerably higher than that of the first comparative lower blow boxes CA, having openings with a diameter of 1.0 mm, and of the second comparative lower blow boxes CB, having openings with a diameter of 5 mm.

Similarly, the first lower blow boxes 26, illustrated hereinbefore with reference to FIG. 3, may also be provided with openings 48 that are round and have a diameter of 2.5 mm on its upper face 44. Those openings 48 would behave in a similar manner as the openings 60, and provide an improved heat transfer over prior art blow boxes having openings of a diameter of, for example, 5 mm, in accordance with the principles illustrated in FIG. 7. The groove perforations 46 of the first lower blow box 26 have a somewhat different purpose, namely that of stabilizing the web 18, and the diameter of those openings 46 may thus be influenced by other parameters, possibly resulting in a different hole diameter than the openings 48.

Figure 8:
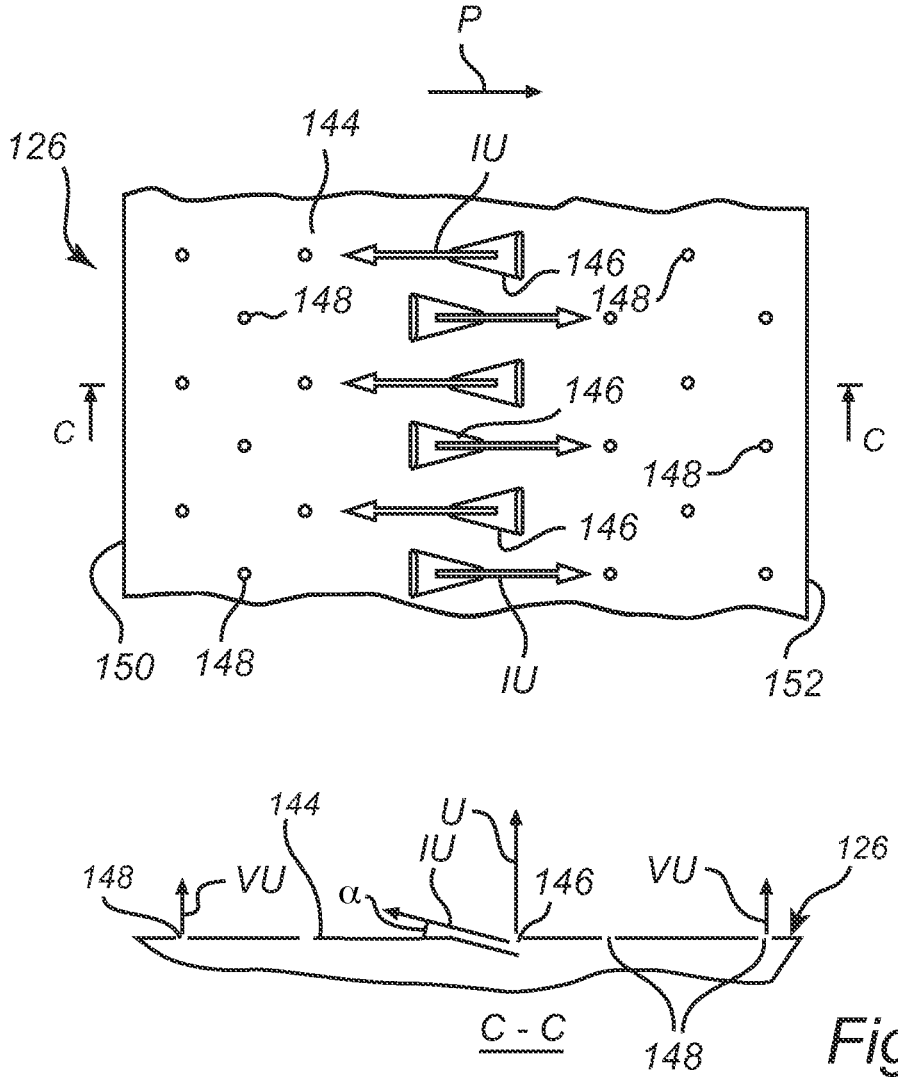
FIG. 8 is a schematic top view, and illustrates an alternative first lower blow box.

FIG. 8 illustrates an alternative first lower blow box 126. An arrow P illustrates the intended path along which the web is to pass over an upper face 144 of the first lower blow box 126. The upper face 144 comprises centrally arranged first type of openings 146, which are "inclination type" openings of a type sometimes referred to as "eyelid perforations". In the first lower blow box 126 at least 30%, often at least 40%, of the total flow of air supplied thereto is blown via eyelid perforations 146. A portion of the flow of air blown via the eyelid perforations 146 may be blown at an angle which is larger than 60°, as indicated by means of an arrow U in the cross-section C-C of FIG. 8. Of the total air flow supplied to the lower blow box 126, at least 25% may be blown at an angle $\alpha$ of less than 60° to the upper face 144 of the first lower blow box 126.

The eyelid perforations 146, which may have a similar design as the openings referred to as "eyelid perforations 6" in WO 97/16594, and which are described with reference to FIGS. 2 and 3 of WO 97/16594, provide the hot drying air blown therethrough with an inclination. As can be seen from FIG. 8 of the present application, the perforations 146 are arranged on the face 144 in an alternating manner, such that every second flow IU will be directed to the left, as illustrated in FIG. 8, and every second flow IU will be directed to the right.

Continuing with the description of FIG. 8 of the present application, the upper face 144 is provided with a second type of openings 148, that are arranged close to the sides 150, 152 of the blow box 126. The second type of openings 148 are of the "non-inclined type" that are distributed over the upper face 144. The openings 148 may be round holes, with a diameter of 1.8 to 3.1 mm. The second type of openings 148 blow the hot drying air upwards to form the flows VU, as best seen in the cross-section C-C.

By varying the number and size of the first type of openings 146 and the number and size of the second type of openings 148 a suitable pressure-drop relation between first and second types of openings 146, 148 may be achieved, such that, for example, 65% of the total flow of air blown to the first lower blow box 126 is ejected via the first type of openings 146, and 35% of the total flow of air blown to the first lower blow box 126 is ejected via the second type of openings 148. The degree of perforation, as defined hereinbefore, may, for example, be 1.5%. The degree of perforation can be varied to suit the weight, dryness, etc. of the web 18 to be dried. Often the degree of perforation of the first lower blow box 126 would be 0.5-3.0%.

The type of first lower blow box 126 illustrated in FIG. 8 tends to provide a more stable path of the web 18 than the type of first lower blow box 26 illustrated in FIG. 3, and the same or better heat transfer.

Figure 9:
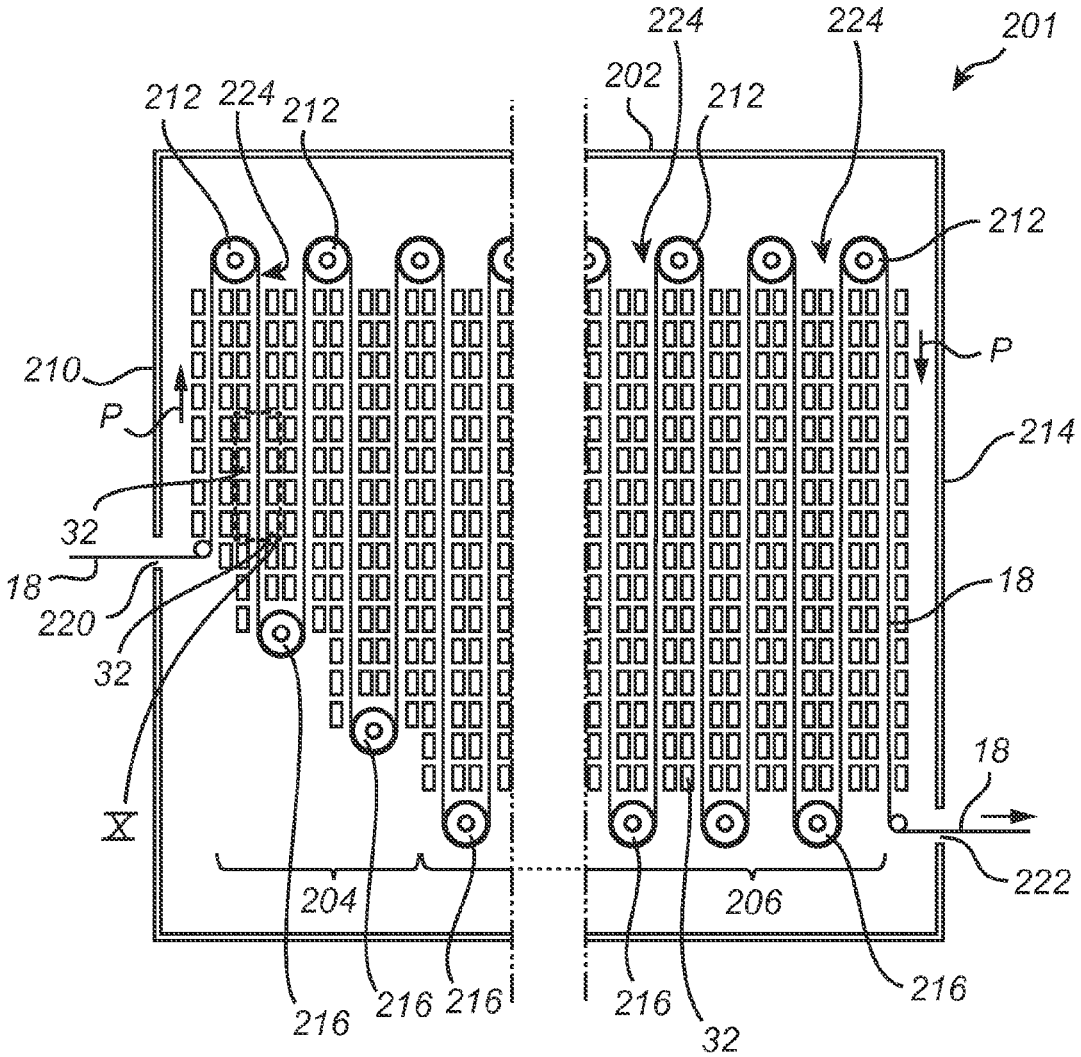
FIG. 9 is a schematic side view, and illustrates a drying box for drying a web of cellulose pulp according to another embodiment.

FIG. 9 illustrates a vertical cellulose pulp drying box 201 in which a wet pulp web 18 is dried by means of hot air while travelling along a number of drying sections 224, that may, in a vertical cellulose pulp drying box 201, be referred to as drying windings 224. The cellulose pulp web 18 is dried in the vertical cellulose pulp drying box 201 while travelling vertically upwards and downwards along the drying windings 224 between upper turning rolls 212 and lower turning rolls 216.

The vertical drying box 201 may typically comprise 4-80 windings 224, for example 40 windings 224. For clarity purposes a smaller number of windings 224 are illustrated in FIG. 9, and the middle section of the drying box 201 is cut away, which is illustrated by vertical dotted lines in FIG. 9.

A wet pulp web 18 enters the drying box 201 via an inlet 220 arranged in a first side wall 210 of a housing 202. In the embodiment of FIG. 9 the inlet 220 is arranged in the central portion of the side wall 210, but the inlet 220 may, in an alternative embodiment, be arranged in another position along the height of the side wall 210. The web 18 is, after entering the housing 202 via the inlet 220, forwarded essentially vertically upwards, as illustrated with an arrow P in FIG. 9, in the drying box 201 until the web 18 reaches an upper turning roll 212. The web 18 is turned around the upper turning roll 212 and travels essentially vertically downwards in the drying box 201 until the web 18 reaches a lower turning roll 216 at which the web 18 is again turned. In this manner the web 18 is fed through the housing 202 and travels vertically upwards and downwards in an alternating manner from the inlet 220 at the first side wall 210 of the housing 202 to an outlet 222 arranged in a second side wall 214 of the housing 202. The dried web 18 leaves the drying box 201 via the outlet 222 which, in the embodiment of FIG. 9, is arranged in the lower portion of the second side wall 214. The outlet 222 may, in an alternative embodiment, be arranged in another position along the height of the side wall 214.

The web 18 is dried by means of air blown from blow boxes 32 arranged to the left and to the right of each winding 224, as will be described in more detail hereinafter with reference to FIG. 10. As is seen in FIG. 9 the length of the windings 224 is not constant throughout the entire drying box 201. Those windings 224 that are arranged adjacent to the inlet 220 have a shorter length than the windings 224 arranged in the other parts of the drying box 201. As illustrated in FIG. 9 that winding 224 which is arranged immediately after the inlet 220 is the shortest one, and is followed by a stepwise increase in the length of the following four windings 224. The sixth winding 224 and the windings 224 following thereafter, have a full length. With a stepwise increase in the length of the windings 224, as seen in the direction of web travel, the risk of web break is reduced in that portion of the drying box 201 which is closest to the inlet 220, where the web 18 is relatively heavy, due to a large water content, and fragile. Thus, having shorter windings 224 adjacent to the inlet 220 decreases the risk of web breaks. It is, however, possible to have the same length of all windings 224 in the entire drying box 201. The vertical length of each winding 224, i.e. the vertical distance between an upper turning roll 212 and a lower turning roll 216, may typically be 2-60 meters.

Optionally, the drying box 201 could be provided with a first drying zone 204, comprising the first five windings 224, and a second drying zone 206, comprising the remaining windings 224. The two drying zones 204, 206 could be provided with blow boxes of different mechanical design, and/or could be supplied with drying air of different temperatures, and/or could be supplied with different relative amounts of drying air, and/or could have different lengths of the windings 224, to achieve low risk of web breaks and optimum drying both in the first drying zone 204, in which the web 18 is relatively heavy and has a high water content, and in the second drying zone 206, in which the web 18 is relatively dry, and has a lower weight.

Figure 10:
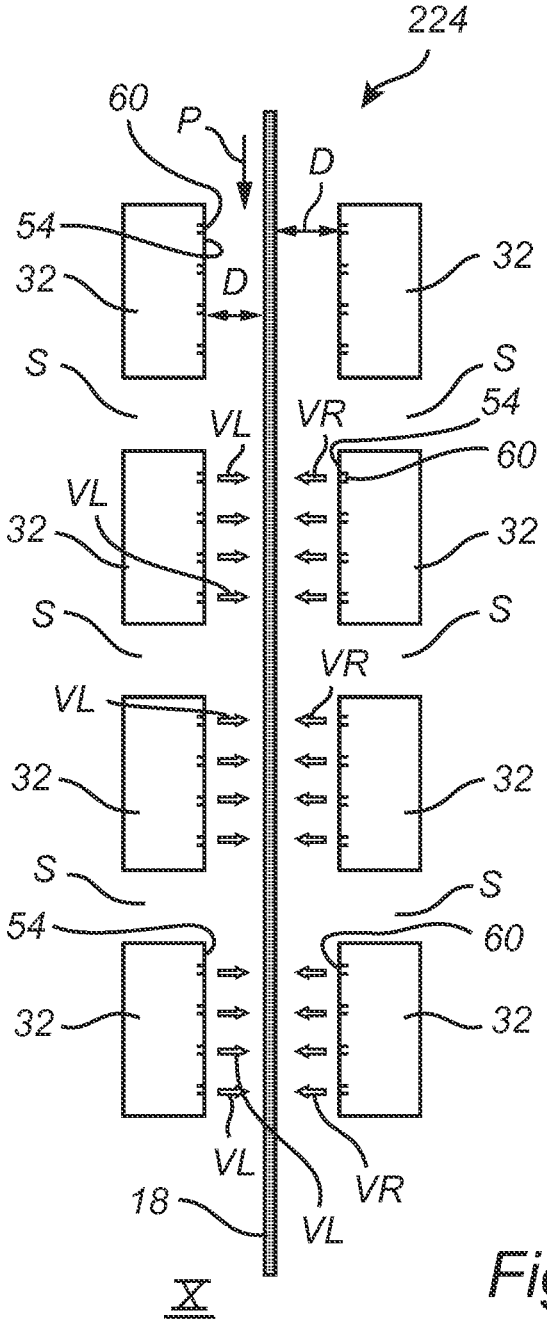
FIG. 10 is a schematic side view, and illustrates the area X of FIG. 9.

FIG. 10 is an enlarged side view of the area X of FIG. 9 and illustrates a portion of a winding 224 in which the web 18 travels vertically downwards. Blow boxes 32 are arranged to the left and to the right of the web 18 and discharge hot air onto the web 18 from the left, illustrated by arrows VL, and from the right, illustrated by arrows VR. The distance D between the web 18 and the blow boxes 32 may typically be 4 to 50 mm, preferably 5 to 30 mm, and most preferably 5 to 20 mm. The hot drying air blown by the blow boxes 32 is evacuated via gaps S formed between vertically adjacent blow boxes 32. The blow boxes 32 are of the type which is illustrated in FIG. 5, although the blow boxes 32 are arranged in the drying box 201 for blowing drying air from the side, in a horizontal direction, instead of upwards as in the drying box 1, and comprises openings 60 of the "non-inclined type" that are distributed over the face 54, which is adapted to face the web 18, of the respective blow box 32. The openings 60 distributed over the face 54 of the blow box 32 may be round holes, with a characteristic measure in the form of a diameter of 1.8 to 3.1 mm. According to one embodiment, the openings 60 have a diameter of 2.0 to 2.8 mm. According to a further embodiment, the openings 60 have a diameter of 2.2 to 2.7 mm It will be appreciated that numerous variants of the above described embodiments are possible within the scope of the appended claims.

Hereinbefore it has been described that the openings 48, 60 are round holes that have a characteristic measure in the form of a diameter of 1.8 to 3.1 mm. It will be appreciated that other shapes than round holes are also possible for use as openings. For example, the openings 48, 60 could be given the shape of a square, a rectangle, a triangle, an oval, a pentagon, a hexagon, etc. The characteristic measure of such an alternative shape always relates to the diameter of a round opening having the same open area as the opening in question. Hence, for example, a square opening having a side of 2.2 mm would have an open area of about 4.9 $mm^2$. A round hole with that same open area of 4.9 $mm^2$ would have a diameter of 2.5 mm. Thus, the characteristic measure of the square opening having a side of 2.2 mm would in fact be 2.5 mm, since 2.5 mm is the diameter of a round hole having the same open area as the square opening in question.

Hereinbefore it has been described that the drying box 1 comprises a first drying zone 4 being provided with the first lower blow boxes 26, or 126, and a second drying zone 6 being provided with the second lower blow boxes 32. It will be appreciated that the drying box may have any number of drying zones, with or without a cooling zone. Furthermore, the drying box may have a single drying zone. Thus, for example, the drying box could be provided with solely first lower blow boxes 26, 126, of the types illustrated in FIGS. 3 and 8. Furthermore, the drying box could be provided with solely second lower blow boxes 32 of the type illustrated in FIG. 5.

Hereinbefore it has been described, with reference to FIG. 1, that the drying box 1 comprises a first drying zone 4, a second drying zone 6, and a cooling zone 8. It will be appreciated that many alternative embodiments are possible. For example, it is also possible to design a drying box having a first drying zone 4, and a second drying zone 6, but no cooling zone, in the event that cooling is not required.

As described hereinbefore, the third lower blow boxes 38 of the cooling zone 8 may have the same general design as the first lower blow boxes 26, 126 illustrated in FIGS. 3 and 8, respectively, or the same general design as the second lower blow boxes 32 illustrated in FIG. 5.

Utilizing third lower blow boxes 38 having the same general design as the second lower blow boxes 32 as illustrated in FIG. 5 has the advantage that the heat transfer will be high, similar to the heat transfer illustrated for the second lower blow box 32 illustrated and described in conjunction with FIG. 7. Hence, the cooling in the cooling zone 8 becomes very efficient.

Utilizing third lower blow boxes 38 having the same general design as the first lower blow boxes 26 or 126, as illustrated in FIGS. 3 and 8, respectively, has the advantage that the web 18 leaving the drying box 1 via the outlet 22 is stabilized, with little vertical movement. This may be an advantage to downstream equipment, such as a web position control unit, a web cutter etc. that handle the dried web 18 leaving the drying box 1.

Hence, if heat transfer has the highest priority in the cooling zone 8, then it would be suitable to utilize as the third lower blow boxes 38 a design of the general type disclosed in FIG. 5. If, on the other hand, web stability has the highest priority in the cooling zone 8, then it would be suitable to utilize as the third blow boxes 38 a design of the general type disclosed in FIG. 3 or 8. A further option is to arrange a cooling zone 8 which has one or more cooling decks 36 having lower blow boxes 38 of the design illustrated in FIG. 5 to obtain efficient cooling, with such a cooling zone 8 having a last cooling deck 36, just upstream of the outlet 22 of the drying box 1, which is provided with third lower blow boxes 38 of a design of the general type disclosed in FIG. 3 or 8 to obtain good web stability just before the web 18 leaves the drying box 1. If web stability has the highest priority, but the drying box has no cooling zone, then a third drying zone could be arranged downstream of the second drying zone. Such a third drying zone would typically have drying decks that would resemble the first drying decks 24 of the first drying zone 4, and have first lower blow boxes 26 or 126 that would yield high web stability. Such a third drying zone would typically have just one to four drying decks.

Hereinbefore it has been described that the drying box 1 has totally 19 drying decks. Of these drying decks totally 8 decks (42% of the total number of drying decks) belong to the first drying zone 4, and totally 11 decks (58% of the total number of drying decks) belong to the second drying zone 6. In a drying box having two drying zones 4, 6 typically 10-70% of the total number of drying decks would belong to the first drying zone 4 and be provided with first lower blow boxes 26 or 126 of the type illustrated in FIGS. 3 and 8, respectively, and, correspondingly, typically 30-90% of the total number of drying decks would belong to the second drying zone 6 and be provided with second lower blow boxes 32 of the type illustrated in FIG. 5. Normally, the first drying zone 4 would only have that many drying decks that are required for the web 18 to obtain a tensile strength being sufficient for the second drying zone 6. In case there is a third, and even fourth drying zone, those would normally reduce the number of drying decks of the second drying zone. Typically the first drying zone 4 would comprise at least two first drying decks 24.

Hereinbefore, it has been described that the first lower blow boxes 26 would be provided with inclination type openings 46 of the "groove perforation" type as disclosed in U.S. Pat. No. 4,837,947, or inclination type openings 146 of the "eyelid perforation" type disclosed in WO 97/16594. It will be appreciated that the inclination type openings 46 may also have an alternative design. An example of such an alternative design is disclosed in U.S. Pat. No. 5,471,766. In FIG. 6 of U.S. Pat. No. 5,471,766 a blow box is disclosed which has a central V-shaped groove, which is similar to that of U.S. Pat. No. 4,837,947, but which has a slightly lower depth.

Hereinbefore it has been described that the gas supplied to the blow boxes 26, 28, 32, 34, 40, 126, is air. It will be appreciated that in some cases the gas supplied to the blow box may be another type of gas, for example air mixed with combustion gases.

It will be appreciated that different types of fixation type of blow boxes could be utilized in the drying box. Hence, a first drying zone could be provided with first lower blow boxes 26, 126 of the type illustrated in FIG. 3 and FIG. 8, respectively. Hence, in the first drying zone a comparably large fixation force would be at hand. A second drying zone could be provided with first lower blow boxes being similar to the type illustrated in FIG. 3 and FIG. 8, respectively, but having a lower fixation force. Such lower fixation force could be achieved, for example, by increasing the number of second type of openings 48, 148, such that less drying air passes through the inclination type perforations 46, 146. This would yield a lower fixation force, which may still be acceptable, since the web has already gained an increased tensile strength in the first drying zone. Then a third drying zone commences, such third drying zone having drying decks and second lower blow boxes of the type illustrated in FIGS. 4 and 5. Hence, the different types of blow boxes can be arranged in various ways to obtain suitable conditions with regard to the fixation force and the heat transfer for the particular web 18 that is to be dried in the drying box 1. Thus, a drying box could be provided with two or more drying zones, typically 2 to 10 drying zones.

In FIG. 4 it has been illustrated that each upper blow box 34 is arranged vertically above a respective lower blow box 32. It will be appreciated that other arrangements of upper and lower blow boxes could also be utilized. One example of such an alternative arrangement is a so-called staggered arrangement in which each upper blow box 34 is centered above the gap S between two adjacent lower blow boxes 32.

Hereinbefore it has been described that the first drying zone 4 comprises first lower blow boxes 26, 126, and that the second drying zone 6 comprises second lower blow boxes 32. It will be appreciated that mixing of blow boxes in the respective drying zone is possible. Hence, the first drying zone 4 could, for example, comprise up to 25% second lower blow boxes 32, and the second drying zone 6 could comprise up to 25% first lower blow boxes 26, 126. Also other types of lower blow boxes could be comprised in the first and second drying zones. Preferably, in the first drying zone 4, at least 75% of the lower blow boxes should be first lower blow boxes 26, and in the second drying zone 6, at least 75% of the lower blow boxes should be second lower blow boxes 32.

To summarize, the cellulose pulp drying box 1, 201 for drying a web 18 of cellulose pulp comprises blow boxes 26, 32, 126 that are operative for blowing gas towards the web 18 of cellulose pulp for drying the pulp. At least 10% of the total number of blow boxes of the drying box 1, 201 are provided, in their respective face 44, 54, 144, with openings 48, 60, 148 having a characteristic measure of 1.8 to 3.1 mm. In such blow boxes 26, 32, 126 being provided with openings 48, 60, 148 having a characteristic measure of 1.8 to 3.1 mm those openings 48, 60, 148 having a characteristic measure of 1.8 to 3.1 mm constitute at least 20% of the total degree of perforation of the face 44, 54, 144 of the respective blow box 26, 32, 126.

The invention claimed is:

1. A cellulose pulp drying box for drying a web of cellulose pulp, wherein the cellulose pulp drying box comprises blow boxes that are operative for blowing gas towards the web of cellulose pulp for drying the pulp, wherein at least 10% of the total number of blow boxes of the drying box are provided, in their respective face, with openings having a characteristic measure of 1.8 to 3.1 mm and constituting at least 20% of the total degree of perforation of the face of the respective blow box.

2. The drying box according to claim 1, wherein the openings having a characteristic measure of 1.8 to 3.1 mm are non-inclined type openings.

3. The drying box according to claim 1, further comprising at least one blow box comprising non-inclined type openings having a characteristic measure of 1.8 to 3.1 mm and constituting at least 75% of the total degree of perforation of the blow box.

4. The drying box according to claim 1, wherein at least 10% of the total number of blow boxes of the drying box comprises non-inclined type openings having a characteristic measure of 1.8 to 3.1 mm and constituting at least 75% of the total degree of perforation of the respective blow box.

5. The drying box according to claim 1, wherein the drying box comprises lower blow boxes arranged to bear the web and dry the pulp in accordance with the airborne web principle, wherein at least 20% of the total number of lower blow boxes of the drying box are provided, in their respective upper face, with openings having a characteristic measure of 1.8 to 3.1 mm and constituting at least 20% of the total degree of perforation of the upper face of the respective lower blow box.

6. The drying box according to claim 1, further comprising at least one lower blow box comprising non-inclined type openings and inclination type openings, wherein the non-inclined type openings have a characteristic measure of 1.8 to 3.1 mm and constitute at least 20% of the total degree of perforation of the lower blow box, and wherein the inclination type openings constitute at least 30% of the total degree of perforation of the lower blow box.

7. The drying box according to claim 1, wherein at least 10% of the total number of lower blow boxes of the drying box comprises non-inclined type openings and inclination type openings, wherein the non-inclined type openings have a characteristic measure of 1.8 to 3.1 mm and constitute at least 20% of the total degree of perforation of the respective lower blow box, and wherein the inclination type openings constitute at least 30% of the total degree of perforation of the respective lower blow box.

8. The drying box according to claim 1, wherein at least 10% of the total number of lower blow boxes of the drying box comprises non-inclined type openings having a characteristic measure of 1.8 to 3.1 mm and constituting at least 75% of the total degree of perforation of the respective lower blow box, and at least 10% of the total number of lower blow boxes of the drying box comprises non-inclined type openings and inclination type openings, wherein the non-inclined type openings have a characteristic measure of 1.8 to 3.1 mm and constitute at least 20% of the total degree of perforation of the respective lower blow box, and wherein the inclination type openings constitute at least 30% of the total degree of perforation of the respective lower blow box.

9. The drying box according to claim 1, further comprising at least one drying winding comprising blow boxes arranged to blow gas from both sides of a vertically travelling web of cellulose pulp in accordance with the vertical cellulose pulp drying principle.

10. The drying box according to claim 1, wherein said characteristic measure of the openings is 2.0 to 2.8 mm.

11. The drying box according to claim 1, wherein said characteristic measure of the openings is 2.2 to 2.7 mm.

12. A method of drying a web of cellulose pulp by means of blow boxes that are operative for blowing gas towards the web of cellulose pulp for drying the pulp, wherein the method comprises blowing gas towards the web from blow boxes, wherein, in at least 10% of the total number of blow boxes, at least 20% of the total amount of gas blown towards the web is blown from openings having a characteristic measure of 1.8 to 3.1 mm.

13. The method according to claim 12, wherein, in at least 10% of the total number of blow boxes blowing gas towards the web, at least 75% of the total amount of gas blown towards the web is blown from non-inclined type openings having a characteristic measure of 1.8 to 3.1 mm.

14. The method according to claim 12, wherein, in at least 10% of the total number of blow boxes blowing gas towards the web, at least 20% of the total amount of gas blown towards the web is blown from non-inclined type openings having a characteristic measure of 1.8 to 3.1 mm, and wherein at least 30% of the total amount of gas blown towards the web is blown from inclination type openings.

15. The method according to claim 12, further comprising blowing gas towards the web from lower blow boxes arranged to bear the web for drying the pulp in accordance with the airborne web principle, wherein, in at least 20% of the total number of lower blow boxes, at least 20% of the total amount of gas blown towards the web is blown from openings having a characteristic measure of 1.8 to 3.1 mm.

* * * * *